US009163396B1

(12) United States Patent
Kersey, Jr. et al.

(10) Patent No.: US 9,163,396 B1
(45) Date of Patent: Oct. 20, 2015

(54) MODULAR BUILDING SYSTEM

(71) Applicants: Wendell J. Kersey, Jr., Elko, GA (US); Julian Merchant, Eatonton, GA (US); Tammy K. Pike, Perry, GA (US); Paul W. Paustian, Panama City, FL (US)

(72) Inventors: Wendell J. Kersey, Jr., Elko, GA (US); Julian Merchant, Eatonton, GA (US); Tammy K. Pike, Perry, GA (US); Paul W. Paustian, Panama City, FL (US)

( * ) Notice: Subject to any disclaimer, the term of this patent is extended or adjusted under 35 U.S.C. 154(b) by 0 days.

(21) Appl. No.: 14/206,788

(22) Filed: Mar. 12, 2014

Related U.S. Application Data

(60) Provisional application No. 61/777,658, filed on Mar. 12, 2013, provisional application No. 61/783,510, filed on Mar. 14, 2013.

(51) Int. Cl.
*E04B 7/04* (2006.01)
*E04B 1/41* (2006.01)

(52) U.S. Cl.
CPC .... *E04B 1/40* (2013.01); *E04B 1/41* (2013.01)

(58) Field of Classification Search
USPC ..... 52/91.1, 91.3, 92.1, 92.2, 93.2, 79.9, 52/274, 282.3, 282.4, 285.1, 582.1
See application file for complete search history.

(56) References Cited

U.S. PATENT DOCUMENTS

| | | | | | |
|---|---|---|---|---|---|
| 2,051,707 | A * | 8/1936 | Harrison | 52/838 |
| 2,062,160 | A * | 11/1936 | Calkins et al. | 52/578 |
| 2,095,434 | A * | 10/1937 | Calkins et al. | 52/469 |
| 2,104,500 | A * | 1/1938 | Van Buren | 52/220.1 |
| 3,543,456 | A * | 12/1970 | Gregoire | 52/92.2 |
| 3,928,951 | A * | 12/1975 | Murphy | 52/92.2 |
| 5,487,241 | A * | 1/1996 | Gorrell et al. | 52/79.1 |
| 5,509,242 | A * | 4/1996 | Rechsteiner et al. | 52/270 |
| 6,298,619 | B1 * | 10/2001 | Davie | 52/293.3 |
| 6,643,981 | B2 * | 11/2003 | Pina et al. | 52/91.2 |

* cited by examiner

*Primary Examiner* — Brian D Mattei
(74) *Attorney, Agent, or Firm* — James Creighton Wray

(57) ABSTRACT

A light weight, modular building fastening apparatus which allows rapid construction of custom modular buildings as an improvement to traditional framing systems is provided. The modular fastening system comprises a set of panels that form the roof and walls of the structure which are connected to a set of panels thorough the use of fasteners.

9 Claims, 7 Drawing Sheets

MODULAR BUILDING SYSTEM

This application claims the benefit of U.S. Provisional Application No. 61/777,658 filed on Mar. 12, 2013 and U.S. Provisional Application No. 61/783,510 filed on Mar. 14, 2013, which are hereby incorporated by reference in their entirety as if fully set forth herein.

BACKGROUND OF THE INVENTION

The present invention relates to rapid construction methods for building construction. Traditional framing methods required construction workers to cut building materials on-site to serve as the frame of a building. A need for more efficient methods for building customized structures has been shown, including the use of standardized parts that can be easily customized for different structures.

SUMMARY OF THE INVENTION

The invention is a light weight, quick fastening building system which allows rapid construction of modular structures as an improvement to traditional framing using both steel and wood. The modular system allows builders to customize a framing system to a variety of architectural layouts. The modular nature of the system also saves weight, time, and space in construction efforts.

The invention comprises a number of panels that are fastened together with fasteners and connectors. The panels may be placed to form the roof and walls of a structure. A set of fasteners may be placed near the ends of each panel to fasten one or more panels to a connector. The connectors of each system may be customized to form a particular architectural shape. Although this system comprises many types of building layouts, one embodiment described is a traditional roofed house structure. In this embodiment, one or more continuously-connected modular structures are formed. Depending on the width of the connectors and panels, several matching sets of modular structures may be placed in rows to form the shape of the building, or one wide set of modular structures can be used alone to form the shape of the building.

The roof of the modular structure is formed by roof panels that are connected to the tops of the exterior wall panels and headers with roof panels to exterior wall panel connectors. The roof panels are connected together by a roof ridge connector. A modified double mount may be used in the system to add extra strength to the roof and supporting structures. Headers may be placed at the floor and at the tops of the exterior wall panels of the modular system. The headers may be connected at both upper and lower ends of the exterior wall panels by sets of fasteners.

The roof panels are connected to the exterior wall panels of the structure via two sets of roof to wall connectors. The exterior walls may be formed from a number of panels stacked together with their ends flush and their vertical surfaces aligned. Additionally, the panels of the exterior walls may be held together through the use of interior tongue and groove connections.

The exterior walls may connect to rigid slabs at the base of a building via two sets of wall to slab connectors. The rigid slabs may serve as a foundation for the building. In this way, the connectors support a continuous structure which lends strength and ensures water tightness and insulation integrity.

The invention is a modular building system that has a plurality of rigid connectors and a plurality of prefabricated exterior panels. Each of the rigid connectors is fixedly attached to one or more of the prefabricated exterior panels.

Plural fasteners are included for fixedly attaching the rigid connectors to the prefabricated exterior panels by passing one or more of the fasteners through at least one of the rigid connectors and the prefabricated exterior panels. The plurality of rigid connectors include rigid wall connectors for interconnecting some of the prefabricated exterior panels as wall panels, rigid connectors for connecting the wall panels to others of the prefabricated exterior panels as roof panels, and roof ridge connectors for connecting two or more of the roof panels.

A plurality of the angled connectors is connected to the wall panels, the roof panels, and the roof ridge connectors connected to the roof panels form a rigid roof truss and rigid exterior walls, with the exterior walls giving support to said roof truss. The exterior wall panels are connected to the roof truss to form a continuous rigid structure that serves as the support structure of a building.

The rigid angled connectors include comprise a first set of rigid flanges, shelves, and risers which form an "L" shape with a rigid 90 degree angle, and a continuous second set of rigid roof support plates with angles to the risers. The roof truss has a peaked shape formed by two of the prefabricated panels which are connected together by the roof ridge connectors. The prefabricated exterior wall panels comprise stacks of prefabricated exterior panels that comprise two or more of the panels vertically connected.

The stacks of the panels are connected together with the wall connectors, the edges of each of the panels being flush together, and vertical surfaces of each of the panels being aligned. The stacks of panels are held together by sets of wall panels having corresponding tongue and groove connectors, wherein the rigid connectors further compose rigid footer connectors. The wall panels are fastened to footings with the rigid footing connectors.

The roof ridge connectors are made from two identically shaped side plates welded together at the inner edges.

These and further and other objects and features of the invention are apparent in the disclosure, which includes the above and ongoing written specification, with the drawings.

DETAILED DESCRIPTION

Dimensions are shown on some figures are used as examples, and may vary to facilitate different building shapes and sizes. Prefabricated panels are used to form side walls and roofs of structures. In one embodiment, the prefabricated panels forming the roof may be longer than the prefabricated panels forming the side walls. Alternatively, the prefabricated panels forming the roof and side walls may have similar or equal lengths. Shaped connectors connect panels to each other and to footings.

Figure 1:
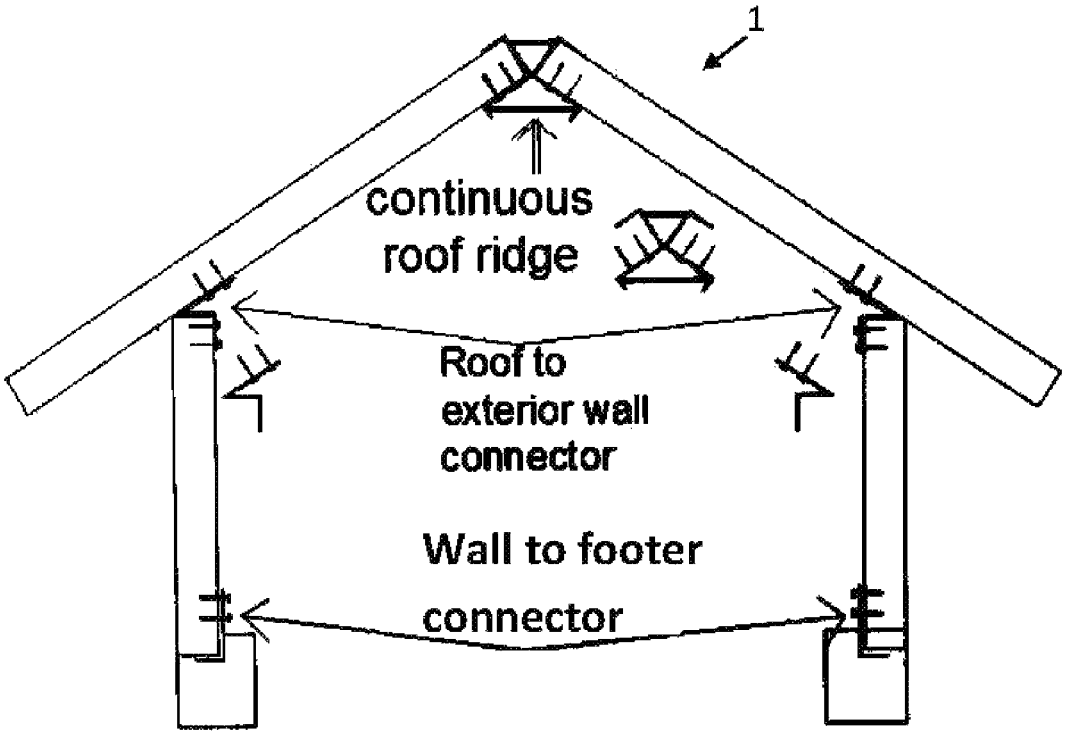
FIG. 1 shows the total modular system with prefabricated panels, roof ridge connectors, roof connectors, wall to roof connectors, footer to wall connectors, and footing connectors.
Figure 2:
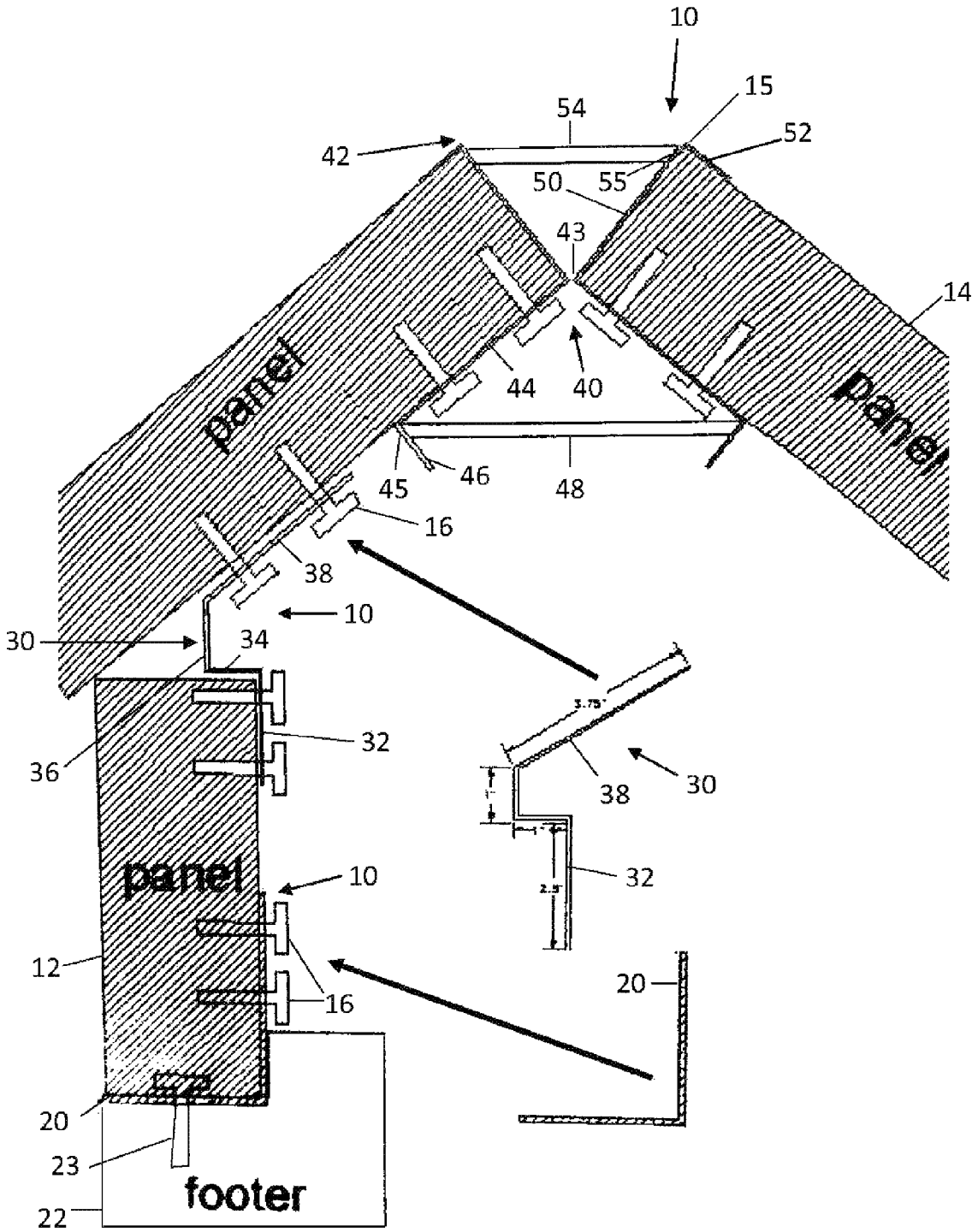
FIG. 2 schematically shows roof ridge connectors, roof connectors, a wall to roof connector, and a footer to wall connector.

FIG. 1 shows an overview of the total modular system 1. FIG. 2 shows cross-sections of various connectors 10 attached to side wall panels 12 and roof panels 14 with screws 16. Footer connector 20 is positioned between a wall panel 12 and a footer 22 that may be composed of poured concrete. Fastener 23 secures the footer connector 20 to footer 22 before the wall panel is erected. The roof to wall connector 30 has a lower flange 32 that is attached to the inside of one or more wall panels 12 with screws 16. One or more wall panels 12 may be connected together through the use of internal tongue and groove connections to create a desired wall height and thickness. In one embodiment, four wall panels 12 are connected together, and screws 16 pass through all four wall panels and into the tongue and groove connections at the point where the panels slide together.

A roof to wall connector 30 has a flange 32 connected along a top inner portion of a side wall panel 12. Roof to wall connector 30 has a shelf 34 that overlies the top of the wall panel 12. Shelf 34 is connected to flange 32, and a riser 36 is connected to the shelf 34. A roof support plate 38 extends at an angle to the riser 36 and is connected to an inside surface of the roof panel 14 with screws 16. The roof to wall connector 30 extends continuously along one or more wall panels 12 and one or more roof panels 14.

A roof ridge connector 40 is made of two identically shaped side plates 42 welded together at the inner edges 43. The plates 42 in connector 40 have continuous roof connection plates 44 which extend between welded edges 43 and lower edges 45. Flanges 46 extend inwards from the bottom side of roof panels 14. A ceiling beam 48 extends between the flanges 46. The plates 42 have roof end plates 50 which cover upper edges 15 of roof panels 14. Extensions 52 that extend in an inward and upward direction may be joined and welded at their tops or may be covered by roof ridging material. Roof ridge beams 54 extend between edges 55 formed between the roof end plates 50 and the extension 52.

Figure 3:
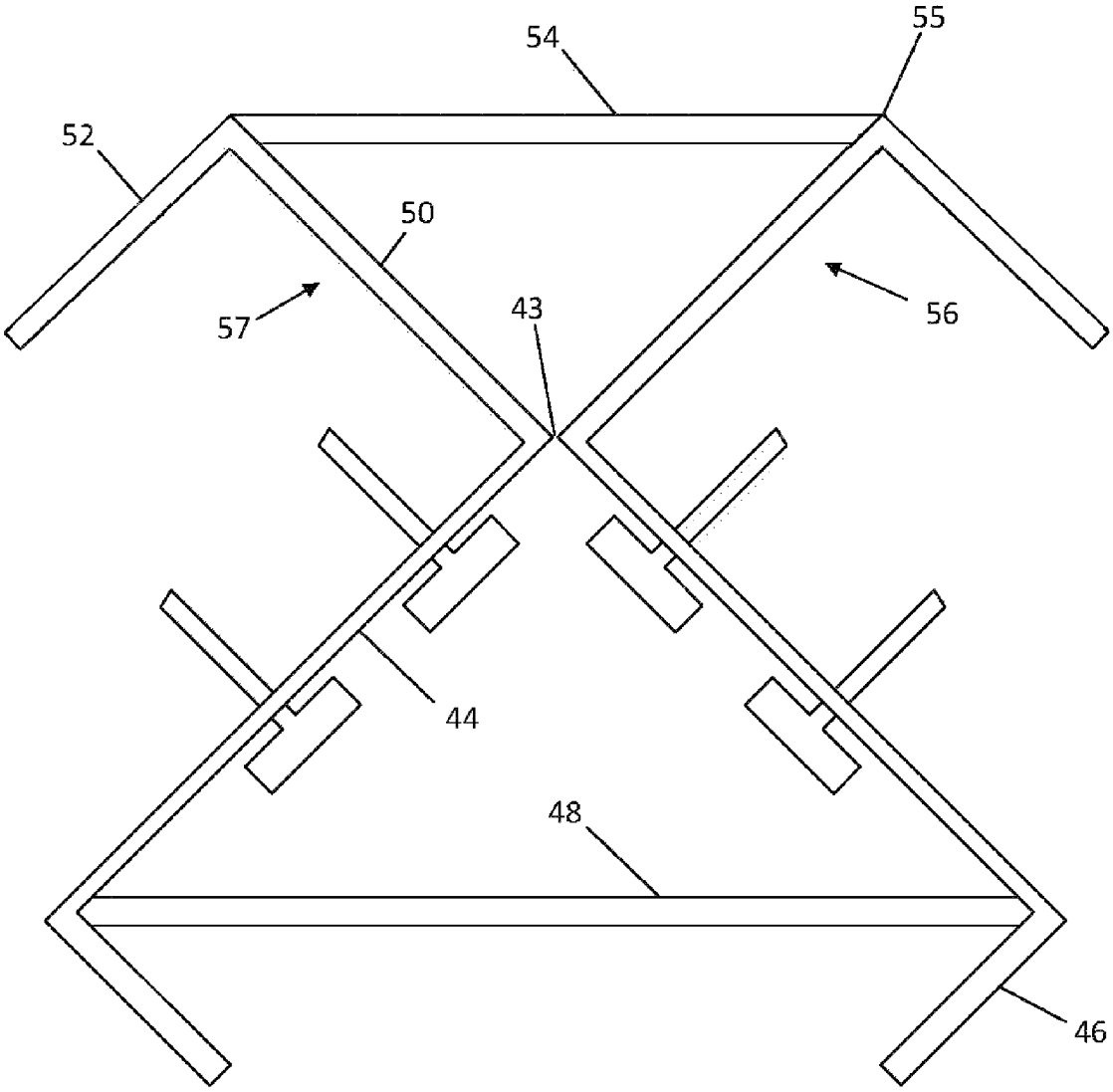
FIG. 3 shows a roof connector.

FIG. 3 shows a roof ridge connector 40 that that runs along part of the length of the roof. The roof ridge connector 40 may be made of 16 gauge red iron steel or other material. The roof ridge connector 40 comprises components 56 and 57 that are similar in shape and may have identical dimensions. Components 56 and 57 are connected together by ceiling beam 48 and roof ridge beam 54. The roof ridge connector is made of continuous 16 ga metal. Two are required for each beam. The connector is made of 16 ga red iron metal and runs the full length of the roof cove. It is made of two components. The drawing above shows both components. It takes two of these to make the beam. As you can see on the lower drawing, two of these beams are welded together to make the beam. A ¼" by 1" flat strap is welded to the components for support, one on the bottom and one on the top as see above. They are made to fit whatever roof pitch is needed for the structure. The top end of the panels are screwed through the beam into the 4 layers of the multiply in the panel to secure the panel to the structure.

The dimensions of the roof ridge connector 40 are customizable to fit whatever roof pitch desired for the structure. The roof plates 44 are connected by screws 16 which pass through the ceiling beam 48 into the four layers of the multiple roof panels to secure the roof ridge connector 40 to the roof panel 14. FIG. 2 shows to the connection of the roof ridge connector 40 to the roof panels 14. Two or more screws 16 connect the wall panels 12 together. In one embodiment, these screws 16 are high tech 2,000 lb. shear strength screws measuring ¼"× 1½".

Figure 4:
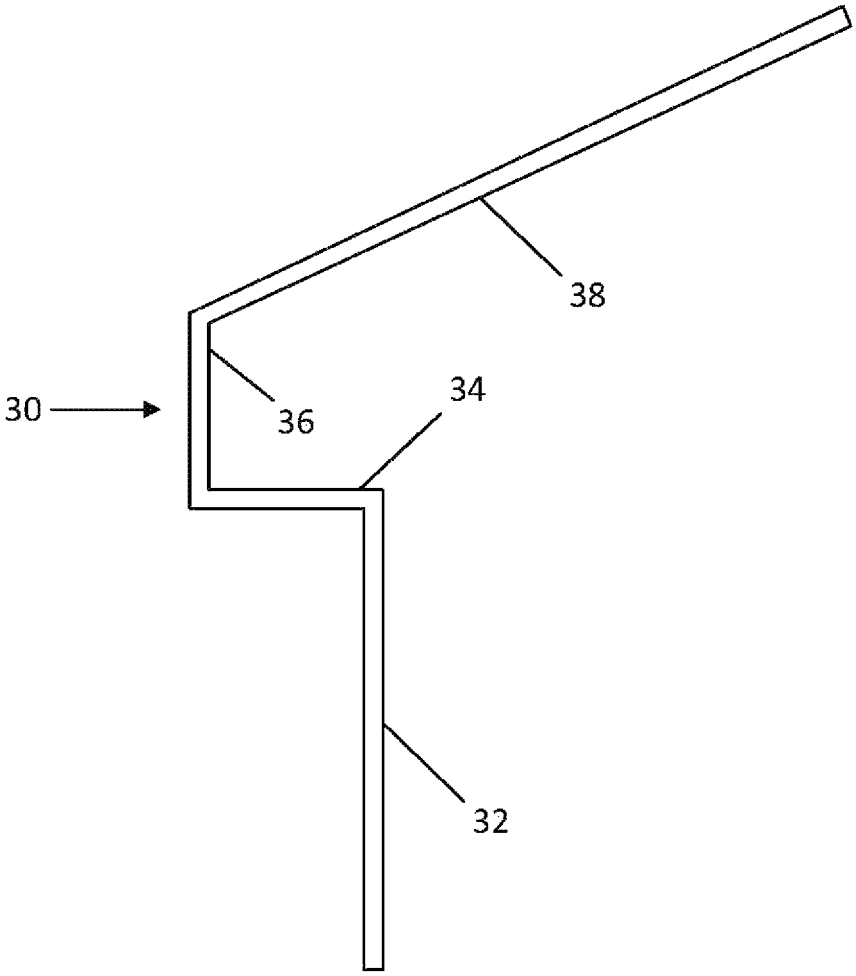
FIG. 4 shows a wall to roof connector.

FIG. 4 shows a roof to wall connector 30 that may be composed of 16 gauge red iron or other material. The position of the roof to wall connector 30 can be seen in relation to the wall panels 12 and roof panels 14 in FIG. 2. Roof to wall connector 30 sits on the top of the wall panel 12 and connects the wall panel 12 to the roof panel 14. The roof to wall connector 30 may run the total length of the wall panel 12 or a portion of the length of the wall panel 12. The top linear portion of the roof to wall connector 30 is bent at an angle that facilitates the desired roof pitch of the building. The connector is made of 16 ga red iron. It sits on the top of the wall and connects the wall to the roof panel. The connector usually comes in 16 feet lengths and runs the total length of wall. The 5" side is bent at the angle, depending on what the roof pitch is. There are ¼"×1½" tech screws that are screwed through the multiply of the panel. The screws go through 4 layers of the tongue and groove at the point where the panels slide together.

Figure 5:
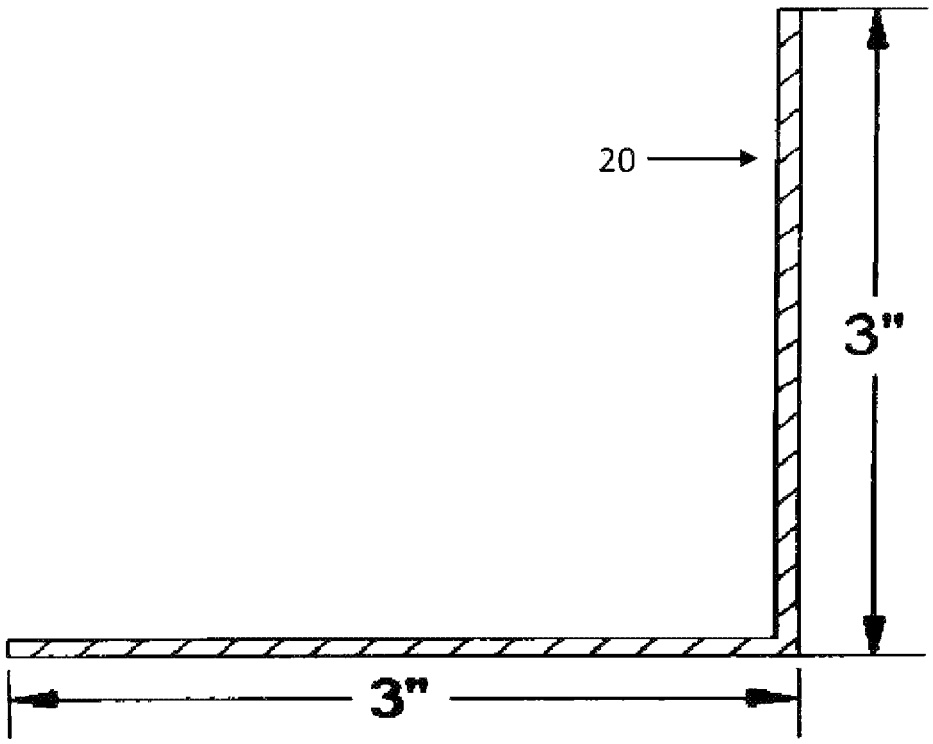
FIG. 5 shows a footer connector.

The footer connector 20 in FIG. 5 forms an "L" shape and may be made of 16 gauge red iron or other material. The position of the footer connector 20 can be seen in relation to the wall panels 12 and footer 22 in FIG. 2. The footer connector 20 is used to connect the wall panels 12 to the footer 22 and runs the total length or a part of the length of the wall panels 12. The footer connector 20 is secured to the wall panels 12 on the interior surface of the structure by several screws 16. The footer connector 20 is also connected to the footer 22 with bolts 23 which may be pre-installed in the footer, for example when the concrete of the footer is being poured. In one embodiment, the footer 22 has a 1½"×3" step down to keep water from penetrating the foundation. Footer connectors 20 of varying dimensions may be used to prevent water ingress on buildings with varying dimensions.

Additionally, the footer connector 20 is used to connect the gable ends of the walls to the roof. The footer connector 20 runs the full length or a portion of the length of the walls panels 12 from the side wall to roof connector 40 to the ridge connector 50. Footer connector 20 is secured to the wall panels 12 on the inside of the structure by screws 16, which may have the same dimensions as the screws used to affix the wall panels 12 together.

Figure 6:
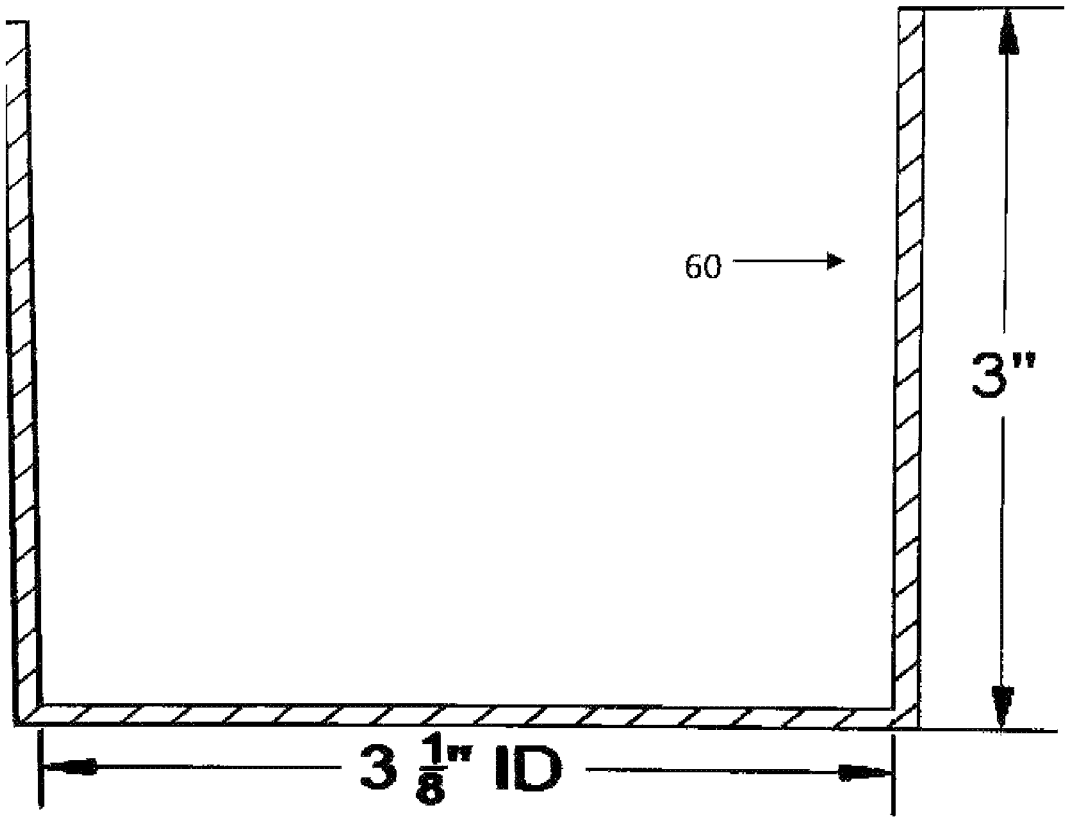
FIG. 6 shows a connector boxing a wall to door or wall to window.

FIG. 6 shows connector 60 that may be made of 16 gauge red iron. Connector 60 is made in the shape of a c-channel and is used to cap the top of the walls panels 12 and runs the total length of the wall panels 12. Connector 60 is also used to box in window openings and door openings in the walls of the structure. Connector 60 is secured to the wall panels 12 on the interior surface of the modular structure with screws 16. The connector is made of 16 ga red iron. It is made in the shape of a c-channel and is used to cap the top of the walls and runs the total length of the walls. It is also used to box in window openings and door openings. It is secured to the panels on the inside of the structure by ¼"×1½" tech screws. These screws are inserted through 4 layers of the multiply, the area where the panels are slid together in the tongue and groove areas.

Figure 7:
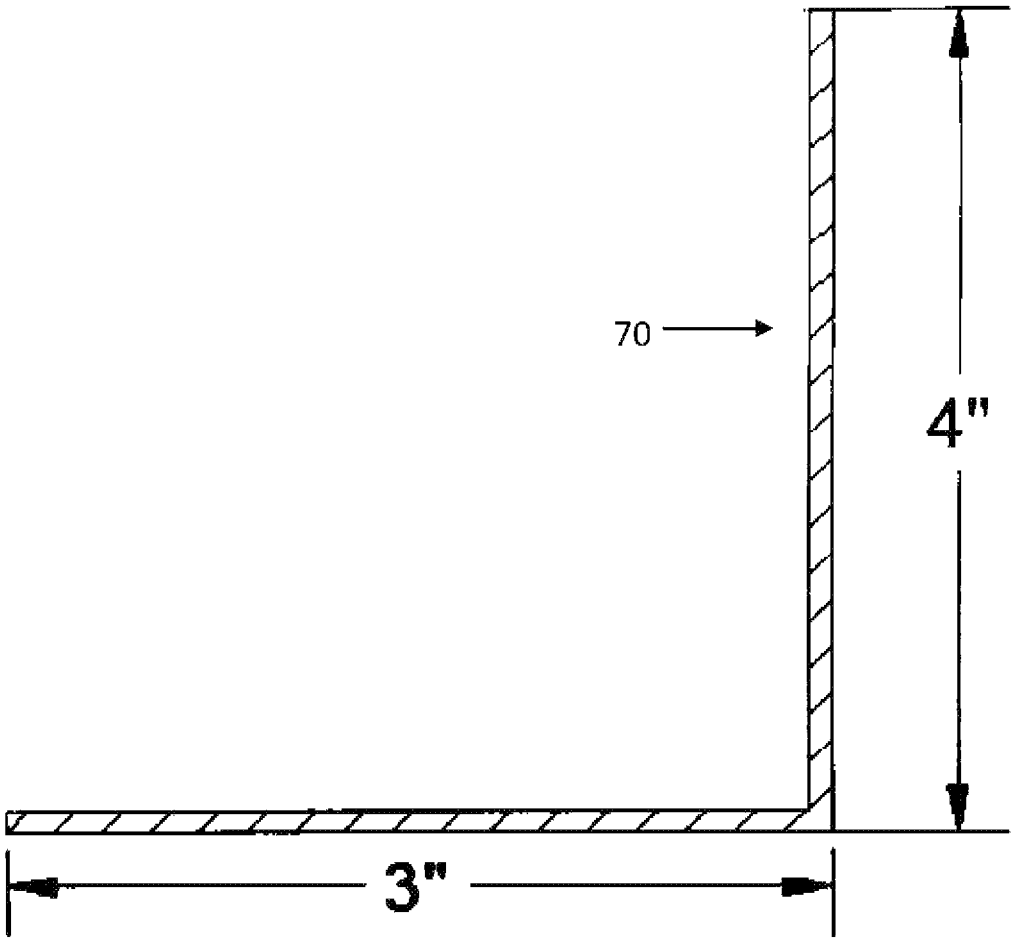
FIG. 7 shows a footer to wall connector.

FIG. 7 shows footer to wall connector 70 that may be made of gauge red iron or other material. Footer to wall connector 70 is made in the shape of an "L" and is used to connect the wall panels 12 to other walls in the running vertical corners. Footer to wall connector 70 may run the entire length or a part of the length of each wall corner. Footer to wall connectors 70 are secured to the wall panels 12 on the inside of the structure with screws 16. The connector is made of 16 ga red iron. It is made in the shape of a L and is used to connect the walls to the footer and runs the total length of the walls. It is secured to the panels on the inside of the structure by ¼"×1½" tech screws. These screws are inserted through 4 layers of the multiply, the area where the panels are slid together in the tongue and groove areas. It is also connected to the footer with bolts pre-installed in the footer when the footer is being poured. The footer has a 1½"×3" step down to keep water from penetrating the foundation.

This same connector is used to connect the gable ends of the walls the roof. It runs the full length of the walls from the side wall/roof connector to the ridge beam. It is secured to the panels on the inside of the structure by ¼"×1½" tech screws. hese screws are inserted through 4 layers of the multiply, the area where the panels are slid together in the tongue and groove areas.

While the invention has been described with reference to specific embodiments, modifications and variations of the invention may be constructed without departing from the scope of the invention.

The invention claimed is:

1. A modular building system comprising:

a plurality of rigid connectors;

a plurality of prefabricated exterior panels;

wherein each of the rigid connectors is fixedly attached to one or more of the prefabricated exterior panels;

plural fasteners for fixedly attaching the rigid connectors to the prefabricated exterior panels by passing one or more of the fasteners through at least one of the rigid connectors and the prefabricated exterior panels;

wherein the prefabricated exterior panels comprise prefabricated exterior wall panels and prefabricated roof panels;

wherein the plurality of rigid connectors comprise rigid footing to exterior wall connectors interconnecting footings to the prefabricated exterior wall panels, rigid wall to roof connectors for connecting the prefabricated exterior wall panels to the prefabricated roof panels, and roof ridge connectors for connecting two of the prefabricated roof panels;

wherein a plurality of the angled wall to roof connectors are connected to the prefabricated exterior wall panels and the prefabricated roof panels, and the roof ridge connectors are connected to the roof panels to form a rigid roof truss, with the prefabricated exterior walls giving support to said roof truss;

wherein the exterior wall panels are connected to the roof truss to form a continuous rigid structure that serves as the support structure of a building, wherein the roof ridge connector comprises two channel-shaped beams which receive and within which channels fit upper edges of the prefabricated roof panels, the two channel-shaped beams having contacting lower corners welded together and having a top flat strap welded between upper corners of the channel-shaped beams.

2. The system of claim 1, wherein each of the wall to roof connectors comprises a rigid vertical flange connected to one of the prefabricated exterior wall panels, a shelf on top of the one of the vertical wall panels, a vertical riser extending upward from the shelf to form an "L" shape with a rigid 90 degree angle with the shelf, and a continuous rigid roof support plate at an angle to the riser.

3. The system of claim 1, wherein the roof truss has a peaked shape formed by the prefabricated roof panels which are connected together by the roof ridge connectors.

4. The system of claim 1, wherein the roof ridge connectors are made from two identically shaped side plates welded together at the inner edges.

5. The apparatus of claim 1, further comprising a bottom flat strap welded between lower flanges of the channel-shaped beams.

6. A method for constructing a modular building comprising:

providing a plurality of rigid connectors;

providing a plurality of prefabricated exterior panels;

fixedly attaching each of the rigid connectors to one or more of the prefabricated exterior panels;

providing plural fasteners for fixedly attaching the rigid connectors to the prefabricated exterior panels by passing one or more of the fasteners through at least one of the rigid connectors and the prefabricated exterior panels;

wherein the prefabricated exterior panels comprise prefabricated exterior wall panels and prefabricated roof panels;

wherein the providing plurality of rigid connectors comprises providing footing to rigid wall connectors for interconnecting the prefabricated exterior wall panels to footings, providing plural rigid wall to roof connectors for connecting the prefabricated exterior wall panels to the prefabricated roof panels, and providing roof ridge connectors for connecting two or more of the prefabricated roof panels;

forming a rigid roof truss with the plurality of the angled wall to roof connectors connected to the prefabricated exterior wall panels, the prefabricated roof panels and the roof ridge connectors are connected to the prefabricated roof panels to form a rigid roof truss and supporting said roof truss, with the prefabricated exterior wall panels;

wherein the prefabricated exterior wall panels connected to the roof panels to form the roof truss and to form a continuous rigid structure that serves as the support structure of a building, wherein the roof ridge connector comprises two channel-shaped beams which receive and within which channels fit upper edges of the prefabricated roof panels, the two channel-shaped beams having contacting lower corners welded together and having a top flat strap welded between upper corners of the channel-shaped beams.

7. The method of claim 6, wherein the providing the rigid wall to roof connectors comprises providing each of the wall to roof connectors with rigid flange, a horizontal shelf and a vertical riser, which form an "L" shape with a rigid 90 degree angle, and a rigid roof support plate at an angle to the riser.

8. The method of claim 6, wherein the roof truss has a peaked shape formed by two of the prefabricated roof panels which are connected together by the roof ridge connectors.

9. The method of claim 6, wherein the roof ridge connectors are made from two identically shaped side plates welded together at the inner edges.

* * * * *